United States Patent [19]

Öberg et al.

[11] 4,200,458

[45] Apr. 29, 1980

[54] METHOD FOR THE ALLOYING OF A METAL MELT

[75] Inventors: Karl-Erik Öberg, Viken; Harry Bertheussen, Degerfors, both of Sweden

[73] Assignee: Scandinavian Lancers Aktiebolag, Höggnäs, Sweden

[21] Appl. No.: 962,937

[22] Filed: Nov. 22, 1978

[30] Foreign Application Priority Data

Sep. 6, 1978 [GB] United Kingdom ..... 35776/78

[51] Int. Cl.[2] ..... C22C 33/08

[52] U.S. Cl. ..... 75/129; 75/53; 75/58; 75/130 R

[58] Field of Search ..... 75/53, 129, 130 R, 58

[56] References Cited

U.S. PATENT DOCUMENTS

| | | | |
|---|---|---|---|
| 3,929,464 | 12/1975 | Todd | 75/53 |
| 3,955,966 | 5/1976 | Meichsner | 75/53 |
| 3,998,625 | 12/1976 | Koros | 75/53 |

*Primary Examiner*—P. D. Rosenberg
*Attorney, Agent, or Firm*—Murray and Whisenhunt

[57] ABSTRACT

A method for the alloying of a metal melt with an alloying material by pneumatic injection of such element through a lance which is submerged in the melt. The alloying material may be lead or metals and compounds having physical properties similar to lead.

8 Claims, No Drawings

METHOD FOR THE ALLOYING OF A METAL MELT

The present invention relates to a method for the alloying of a metal melt with an alloying element by pneumatic injection of the alloying element through a lance which is submerged in the melt. The invention is particularly concerned with a method of alloying a steel melt by the injection of particulate lead or other elements having such a high specific weight and/or so large a particle size that the particles are substantially non fluidisable in a carrier gas.

In the alloying of lead into a steel melt, it is of the utmost importance that the lead be in the form of a finely dispersed metallic phase in the bulk of molten metal. In order to achieve this, it has been suggested to utilize pneumatic injection deep into the steel through a lance as this procedure may permit the necessary agitation of the melt. However, injection of particulate lead creates severe problems because particulate lead, as well as other very heavy elements in particulate form, is almost impossible to fluidize in a carrier gas. For this reason, the carrier gas cannot accelerate the lead particles to give them sufficient momentum to introduce them into the melt at the same rate as the carrier gas. For this reason, and probably also owing to its relatively low melting point, the lead has shown a tendency to clog in the region of the mouth of the lance. In order to overcome this problem, it has been suggested, e.g. in German Pat. Specification No. 2,153,379, to vaporize the lead in a carrier gas as it is being injected through the lance into the molten steel. However, in order to be vaporized, the lead must be heated to above its boiling temperature which is about 1740° C. From practical reasons, this is not possible since it would require a steel melt temperature well above 1800° C. and probably even approaching at least 2000° C.

Another method of alloying steel with lead is to inject lead in the form of a particulate lead sulphide which readily can be suspended in a carrier gas. A limitation of this method, however, is that it is restricted to the production of sulphur alloy steels since, otherwise, a post-alloying desulphurizing step would be necessary.

The present invention is directed to a method for the production of lead alloy steels or other metals, as well as steels or other metals alloyed with other heavy and/or large grain alloying elements, by utilizing well established injection techniques but avoiding the drawbacks and limitations of the previously proposed methods. In the method of the present invention, a gas-powder suspension is prepared by fluidizing a first particulate fluidizable material in a carrier gas to form a gas/powder suspension which is then injected into a metallic melt through a lance and accelerates a second particulate material consisting essentially of heavy and/or large grain alloying elements in a manner such that the second particulate material gains momentum sufficient for an efficient injection of the second particulate material into the melt.

The said second particulate material, which is substantially non-fluidisable in the carrier gas, normally consists substantially of particulate lead or an alloy substantially consisting of lead, or a metal having physical properties similar to those of lead, such as bismuth, and/or other metals or compounds where a coarse grain diameter is practical for environmental or manufacturing reasons. At least 90 weight % of the particles of the second particulate material will normally have grain diameters in the range 0.1–2.0 mm, but preferably at least 90 weight % should have grain diameters not exceeding 0.85 mm.

The first particulate material may be any one or more of a wide range of powders which can be fluidized in a gas, including fluidizable metal, and graphite powders. It is preferred, however, the first particulate material, which is to urge the heavier second particulate material through the lance, is chosen from lime (CaO); limestone ($CaCO_3$); and ore concentrate (e.g. $Fe_2O_3$ and/or $Fe_3O_4$); fluorspar ($CaF_2$); silicon-calcium (SiCa); silica sand or other silica ($SiO_2$) rich materials; certain finely divided slags, certain sulphides such as iron sulphide (FeS) and lead sulphide (PbS); graphite; fluidizable metal powders; etc.

Standardized injection lances may be used in the process of the invention, that is a lance having an inner diameter of 15–25 mm, except in the mouth where there usually is a restriction normally having an inner diameter of 8–12 mm. The suspension of said first particulate material is conveniently injected at a rate of 5–100 kg powder per minute so as to urge 20–200 kg of the second, heavy particulate material per minute through the lance into the melt. The carrier gas normally consists of argon but depending on the metallurgical circumstances in each case other gases such as nitrogen or air can be used.

The first and second particulate material can either be mixed in advance in a common dispenser but it is also possible to supply the second particulate material, i.e. the material containing the heavy alloying element successively into a feeding pipe conveying the gas-powder suspension to the lance.

We claim:

1. A method for the alloying of a metal melt with at least one particulate alloying material belonging to the group consisting of lead, and metals, and compounds having physical properties similar to lead, said physical properties including non-fluidizability in a carrier gas of said particulate material when at least 90 weight percent of the particles of the particulate material have grain diameters in the range of 0.1 to 2.0 mm, by pneumatic injection of the non-fluidizable particulate alloying material through a lance into the melt, wherein a gas-powder suspension is prepared by fluidizing a particulate fluidizable material in a carrier gas, said gas-powder suspension being injected into the melt through said lance so as to accelerate said non-fluidizable particulate material so that said non-fluidizable material urged by the gas-powder suspension gains momentum sufficient for an efficient injection of the non-fluidizable material which therethrough is distributed in the melt together with said suspension.

2. A method according to claim 1, said non-fluidizable material substantially consists of particulate lead.

3. A method according to claim 1 or claim 2, wherein said fluidizable material is at least one material belonging to the group consisting of lime, limestone, ore concentrates, fluorospar, silicon-calcium, silica sand and other silica-rich minerals, finely divided slag, fluidizable metal powders and sulfides.

4. An alloyed metal obtained by a process according to claim 1 or claim 2.

5. A method for the alloying of a metal melt with at least one particulate metal alloying material which is non-fluidizable in a carrier gas when at least 90 weight percent of the particles of said particulate material have grain diameters in the range of 0.1 to 2.0 mm, said method comprising pneumatically injecting the non-fluidizable particulate alloying material through a lance into the melt by preparing a gas-powder suspension by fluidizing a particulate material in a carrier gas, introducing said non-fluidizable particulate material into said gas-powder suspension, and thereafter injecting said gas-powder suspension into the melt through said lance so as to accelerate said non-fluidizable particulate material so that said non-fluidizable material urged by the gas-powder suspension gains momentum sufficient for an efficient injection and distribution of the non-fluidizable material in the melt together with said suspension.

6. A method according to claim 5, wherein said particulate metal alloying material is lead.

7. A method according to claim 5 or claim 6, wherein said fluidizable material is selected from the group consisting of lime, limestone, ore concentrates, fluorospar, silicon-calcium, silica sand and other silica-rich materials, finely divided slag, fluidizable metal powders and sulfides.

8. A method for the alloying of a steel melt with particulate lead alloying material which is non-fluidizable in a carrier gas when at least 90 weight percent of the lead particles have grain diameters in the range of 0.1 to 2.0 mm, by pneumatic injection of the particulate lead alloying material through a lance into the melt, said method comprising preparing a gas-powder suspension by fluidizing a particulate fluidizable material in a carrier gas and injecting said gas-powder suspension into the melt through said lance while introducing said lead particles into said gas-powder suspension so as to accelerate said lead particles so that said lead particles urged by the gas-powder suspension gains the momentum sufficient for an efficient injection of the lead particles into the melt.

* * * * *